US008152288B2

(12) United States Patent
Williams et al.

(10) Patent No.: US 8,152,288 B2
(45) Date of Patent: Apr. 10, 2012

(54) METHOD AND SYSTEM FOR ACHIEVING UNIFORM INK AND WEB TEMPERATURES FOR SPREADING

(75) Inventors: James Edward Williams, Penfield, NY (US); Paul John McConville, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 807 days.

(21) Appl. No.: 12/197,492

(22) Filed: Aug. 25, 2008

(65) Prior Publication Data

US 2010/0045720 A1 Feb. 25, 2010

(51) Int. Cl.
*B41J 2/175* (2006.01)
*B41J 2/01* (2006.01)

(52) U.S. Cl. ..... 347/88; 347/102; 347/99; 347/101

(58) Field of Classification Search ..... None
See application file for complete search history.

(56) References Cited

U.S. PATENT DOCUMENTS 5,436,711 A 7/1995 Hauser
6,122,480 A 9/2000 Hwang
6,494,570 B1 * 12/2002 Snyder ..... 347/103
6,725,010 B1 4/2004 Parker
7,151,903 B2 12/2006 Wu et al.
2007/0120930 A1 * 5/2007 Domoto et al. ..... 347/102

* cited by examiner

*Primary Examiner* — Matthew Luu
*Assistant Examiner* — Erica Lin
(74) *Attorney, Agent, or Firm* — Maginot, Moore & Beck, LLP

(57) ABSTRACT

A system for use with a phase change ink imaging device comprises a leveler roller disposed along a web path downstream from a printing station. The leveler roller is formed of a thermally conductive material and includes a heater configured to generate thermal energy to heat the leveler roller to a leveling temperature. The leveler roller is positioned to be partially wrapped by the continuous web in order to generate a predetermined dwell time between the continuous web and the leveler roller as the continuous web is being moved. The predetermined dwell time is configured to allow conductive heat transfer to occur between the continuous web and the leveler roller to equalize the continuous web and the melted phase change ink temperatures on the web to within a predetermined range about the leveling temperature. A midheater is disposed along the web path downstream from the leveler roller. The midheater is configured to heat the continuous web and the melted phase change to a midheating temperature that is greater than the leveling temperature.

15 Claims, 4 Drawing Sheets

METHOD AND SYSTEM FOR ACHIEVING UNIFORM INK AND WEB TEMPERATURES FOR SPREADING

TECHNICAL FIELD

The present disclosure relates to inkjet printing, particularly involving phase-change inks printing on a substantially continuous web.

BACKGROUND

In general, ink jet printing machines or printers include at least one printhead that ejects drops or jets of liquid ink onto a recording or image forming media. A phase change ink jet printer employs phase change inks that are in the solid phase at ambient temperature, but transition to a liquid phase at an elevated temperature. The molten ink can then be ejected onto a printing media by a printhead directly onto an image receiving substrate, or indirectly onto an intermediate imaging member before the image is transferred to an image receiving substrate. Once the ejected ink is on the image receiving substrate, the ink droplets quickly solidify to form an image.

In both the direct and offset printing architecture, images may be formed on a media sheet or a media web. In a web printer, a continuous supply of media, typically provided in a media roll, is mounted onto rollers that are driven by motors. A loose end of the media web is passed through a print zone opposite the print head or heads of the printer. Beyond the print zone, the media web is gripped and pulled by mechanical structures so a portion of the media web continuously moves through the print zone. Tension bars or rollers may be placed in the feed path of the moving web to remove slack from the web so it remains taut without breaking.

In a typical direct printing system, ink is ejected from jets in the print head directly onto the final receiving web. In continuous-web direct to paper printing, a high pressure roller nip, also referred to as a spreader, is used after the ink is jetted onto the web to spread the ink on the web to achieve the desired print quality. The function of the spreader is to take what are essentially isolated droplets of ink on web and smear them out to make a continuous layer by pressure and/or heat so that spaces between adjacent drops are filled and image solids become uniform.

One difficulty faced in spreader performance is variation in the temperature of the ink on the web as the web enters the spreader. For optimum spreader performance, ink and web temperatures should be substantially uniform prior to entering the spreader and be at a temperature that promotes adherence of the melted ink to the web, minimizes "show through" of the ink through the web, and maximizes ink dot spread. Without additional heating, the ink temperature of a given area on the web as it enters the spreader is dependent upon the mass of the ink that is placed on the area during printing and cooling due to the different positions of the print heads from the spreader. Imaged areas on the web having more ink mass, e.g., secondary color solid fill areas having two or more ink layers, retain more energy, or heat, than imaged areas having less ink mass, e.g., primary color solid fill areas having one ink layer and halftone areas. Ink may also lose heat due to pattern dependent lateral cooling. For example, imaged areas of the web at which, for instance, isolated dots, or lines have been placed may lose energy laterally through the web. The rate of speed of the web is also a factor in ink temperature. For example, the faster that the web W travels between the printing zone and the spreader, the less time the ink has to cool due to convective heat loss, and vice versa. Therefore, without additional heat prior to spreading, lines, halftones, primary color solid fill areas, and secondary color solid fill areas, may all be at different ink temperatures upon entering the spreader.

SUMMARY

Accordingly, a system has been developed that enables equalization of the ink and web temperatures prior to ink spreading in direct to paper continuous web solid ink printers. In one embodiment, the system comprises a leveler roller disposed along a web path downstream from a printing station. The leveler roller is formed of a thermally conductive material and includes a heater/cooler configured to generate thermal energy to maintain the leveler roller to a leveling temperature. The leveling temperature is less than a temperature of the continuous web and melted phase change ink on the continuous web. The leveler roller is positioned to be partially wrapped by the continuous web to generate a predetermined dwell time between the continuous web and the leveler roller as the continuous web is being moved. The predetermined dwell time is configured to allow conductive heat transfer to occur between the continuous web and the leveler roller to equalize the continuous web and the melted phase change ink temperatures on the web to within a predetermined range about the leveling temperature. A midheater is disposed along the web path downstream from the leveler roller and upstream from a spreader. The midheater is configured to heat the continuous web and the melted phase change ink to a midheating temperature that is greater than the leveling temperature.

In another embodiment, a direct to paper phase change ink imaging device comprises a substantially continuous web; a web supply and handling system configured to move the continuous web along a web path at a web speed; and a printing station disposed along the web path, the printing station including at least one printhead for applying melted phase-change ink to the continuous web. A leveler roller is disposed along the web path downstream from the printing station, the leveler being formed of a thermally conductive material and including a heater configured to generate thermal energy to heat the leveler roller to a leveling temperature. The leveling temperature is less than a temperature of the continuous web and the melted phase change ink on the web. The leveler roller is partially wrapped by the continuous web to generate a predetermined dwell time between the continuous web and the leveler roller as the continuous web is being moved. The predetermined dwell time is configured to allow conductive heat transfer to occur between the continuous web and the leveler roller to bring a temperature of the continuous web and a temperature of melted phase change ink on the continuous web to within a range about the leveling temperature. A midheater is disposed downstream of the leveler roller along the web path and is configured to heat the continuous web to a midheating temperature greater than the leveling temperature. A spreader is disposed downstream of the midheater along the web path and is configured to apply pressure to the melted phase change ink on the continuous web.

In yet another embodiment, a method of using a direct to paper phase change ink imaging device comprises placing melted phase change ink on a substantially continuous web moving past a printing station. The continuous web is partially wrapped around a leveler roller downstream from the printing station to generate a dwell time between the continuous web and the leveler roller. The leveler roller is heated to a leveling temperature, and the dwell time is configured to allow conductive heat transfer to occur between the continuous web and the leveler roller to bring a temperature of the continuous web and temperatures of the melted phase change ink on the continuous web to within a range about the leveling temperature. The continuous web is then radiantly heated downstream from the leveler roller to a midheating temperature, the midheating temperature being greater than the leveling temperature.

DETAILED DESCRIPTION

Figure 1:
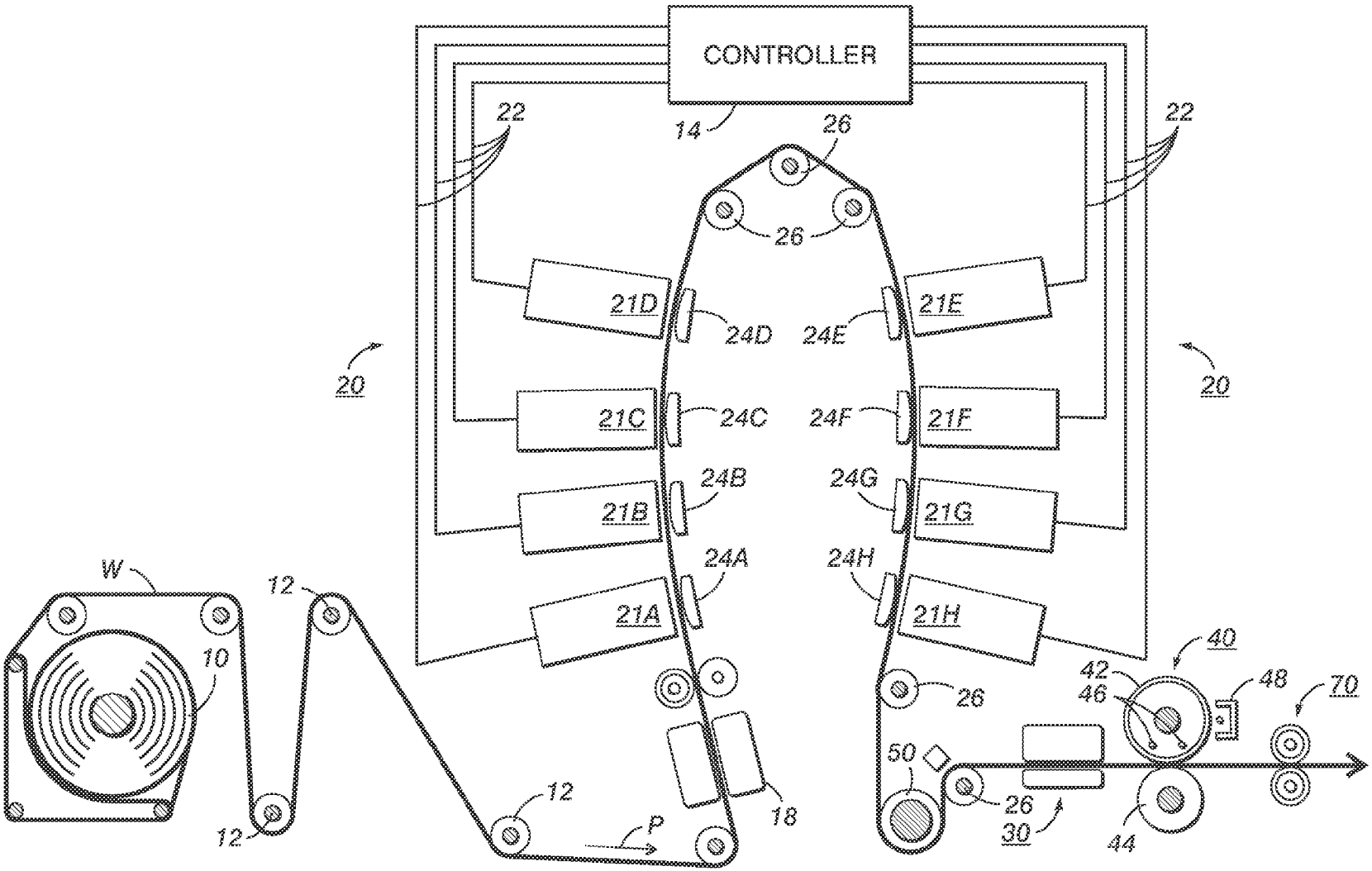
FIG. 1 is a simplified elevational view of a direct-to-sheet, continuous-web, phase-change ink printer.

For a general understanding of the present embodiments, reference is made to the drawings. In the drawings, like reference numerals have been used throughout to designate like elements. FIG. 1 is a simplified elevational view of a direct-to-sheet, continuous-web, phase-change ink printer. A web supply and handling system is configured to supply a very long (i.e., substantially continuous) web W of "substrate" (paper, plastic, or other printable material) from a spool 10. The web W may be unwound as needed, and propelled by a variety of motors, not shown. The web supply and handling system is capable of transporting the web W at a plurality of different speeds. In one embodiment, the web is capable of being moved at any speed between approximately 0 inches per second (ips) and approximately 150 ips. A set of rolls 12 controls the tension of the unwinding web as the web moves through a path.

Along the path there is provided a preheater 18, which brings the web to an initial predetermined temperature. The preheater 18 can rely on contact, radiant, conductive, or convective heat to bring the web W to a target preheat temperature, which in one practical embodiment, is in a range of about 30° C. to about 70° C.

The web W moves through a printing station 20 including a series of printheads 21A-21H, each printhead effectively extending across the width of the web and being able to place ink of one primary color directly (i.e., without use of an intermediate or offset member) onto the moving web. Eight printheads are shown in FIG. 1 although more or fewer printheads may be used. As is generally familiar, each of the four primary-color images placed on overlapping areas on the web W combine to form color images, based on the image data sent to each printhead through image path 22 from print controller 14. In various possible embodiments, there may be provided multiple printheads for each primary color; the printheads can each be formed into a single linear array. The function of each color printhead can be divided among multiple distinct printheads located at different locations along the process direction; or the printheads or portions thereof can be mounted movably in a direction transverse to the process direction P, such as for spot-color applications.

The ink directed to web W in this embodiment is a "phase-change ink," by which is meant that the ink is substantially solid at room temperature and substantially liquid when initially jetted onto the web W. Currently, common phase change inks are typically heated to about 100° C. to 140° C. to melt the solid ink for jetting onto the web W. Generally speaking, the liquid ink cools down quickly upon hitting the web W.

Associated with each printhead is a backing member 24A-24H, typically in the form of a bar or roll, which is arranged substantially opposite the printhead on the other side of web W. Each backing member is used to position the web W so that the gap between the printhead and the sheet stays at a known, constant distance. Each backing member can be controlled to cause the adjacent portion of the web to reach a predetermined "ink-receiving" temperature, in one practical embodiment, of about 40° C. to about 60° C. In various possible embodiments, each backing member can include heating elements, cavities for the flow of liquids therethrough, etc.; alternatively, the "member" can be in the form of a flow of air or other gas against or near a portion of the web W. The combined actions of preheater 18 plus backing members 24 held to a particular target temperature effectively maintains the web W in the printing zone 20 in a predetermined temperature range of about 40° C. to 70° C.

As the partially-imaged web moves to receive inks of various colors throughout the printing station 20, the temperature of the web is maintained within a given range. Ink is jetted at a temperature typically significantly higher than the receiving web's temperature which heats the surrounding paper (or whatever substance the web W is made of). Therefore the members in contact with or near the web in zone 20 must be adjusted so that that the desired web temperature is maintained. For example, although the backing members may have an effect on the web temperature, the air temperature and air flow rate behind and in front of the web may also impact the web temperature. Accordingly, air blowers or fans may be utilized to facilitate control of the web temperature.

The web temperature is kept substantially uniform for the jetting of all inks from printheads in the printing zone 20. This uniformity is valuable for maintaining image quality, and particularly valuable for maintaining constant ink lateral spread (i.e., across the width of web W, such as perpendicular to process direction P) and constant ink penetration of the web. Depending on the thermal properties of the particular inks and the web, this web temperature uniformity may be achieved by preheating the web and using uncontrolled backer members, and/or by controlling the different backer members 24A-24H to different temperatures to keep the substrate temperature substantially constant throughout the printing station. Temperature sensors (not shown) associated with the web W may be used with a control system to achieve this purpose, as well as systems for measuring or inferring (from the image data, for example) how much ink of a given primary color from a printhead is being applied to the web W at a given time. The various backer members can be controlled individually, using input data from the printhead adjacent thereto, as well as from other printheads in the printing station.

Following the printing zone 20, along the path of web W, is a "spreader" 70. The function of the spreader 40 is to take what are essentially isolated droplets of ink on web W and smear them so that spaces between adjacent drops are filled and image solids become uniform. The spreader is configured to use pressure to perform the spreading operation. In one embodiment, heat may also be used to aid in spreading. In addition to spreading the ink, the spreader 40 may also improve image permanence by increasing ink layer cohesion and/or increasing the ink-web adhesion. The spreader 40 includes rolls, such as image-side roll 42 and pressure roll 44, that apply heat and pressure to the web W. Either roll can include heat elements 46 to bring the web W to a temperature in a range from about 35° C. to about 80° C. In one practical embodiment, the roll temperature in spreader 40 is maintained at about 55° C. A roll temperature higher than about 57° C. appears to cause ink to offset to the roll. In one practical embodiment, the nip pressure is set in a range of about 500 to about 2000 psi. Lower nip pressure gives less line spread while higher pressure may reduce pressure roll life.

The spreader 40 may also include a cleaning/oiling station 48 associated with image-side roll 42. Station 48 is suitable for cleaning and/or applying a layer of some lubricant or other material to the roll surface. For example, station 48 may coat the surface of the spreader roll with a lubricant, such as amino silicone oil, which has a viscosity of about 10-200 centipoises.

One difficulty faced in spreader performance is variation in the temperature of the ink on the web as the web enters the spreader. Without additional heating, the ink temperature of a given area on the web as the area enters the spreader is dependent upon the mass of the ink that is placed on the area during printing, the time for cooling, and pattern dependent lateral cooling into the paper. For example, ink temperature increases with increasing ink mass on given areas of the imaged web W. Imaged areas having more ink mass, e.g., secondary color solid fill areas having two or more ink layers, retain more energy, or heat, than imaged areas having less ink mass, e.g., primary color solid fill areas having one ink layer and halftone areas. For the purpose of this discussion, halftone or dithered fill areas are considered to be less than a full ink layer, e.g. a half (0.5) layer of ink. Ink may also lose heat due to pattern dependent lateral cooling. For example, imaged areas of the web at which, for instance, isolated dots, or lines have been placed may lose energy laterally through the web. The rate of speed of the web is also a factor in ink temperature. For example, the faster that the web W travels between the printing zone and the spreader, the less time the ink has to cool due to convective heat loss, and vice versa. Therefore, without additional heat prior to spreading, lines, halftones, primary color solid fill areas, and secondary color solid fill areas, may all be at different ink temperatures upon entering the spreader.

Figure 3:
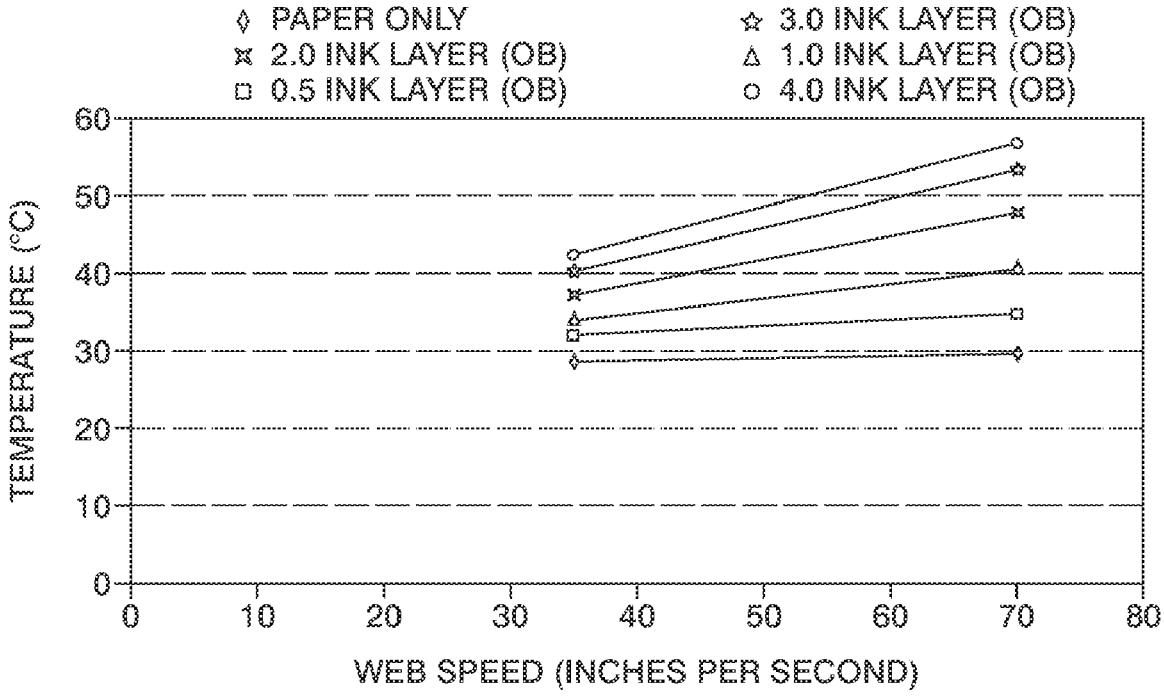
FIG. 3 is a graph showing ink and web temperature spread that may result without leveling or heating the ink and web prior to spreading.

FIG. 3 depicts a graph showing the possible ink temperature spread between areas on the web that have been printed with one, two, three or four layers of ink as well halftone areas and areas with no ink. The ink was applied to the web in given areas with zero layers of ink (web only), half (0.5) layers (halftone), one ink layer, two ink layers, three ink layers, and four ink layers. A temperature sensor was used to detect the temperature of a web upon entering the spreader traveling at two different web speeds, 35 inches/second (ips) and 70 ips. No additional heating was applied to the ink on the web after printing. The effect of convective cooling of the ink on the web can be seen at 35 ips where the ink has more time to cool at the lower speed prior to entering so that the ink temperatures are lower and the ink spread, or difference between the highest and lowest ink temperature, is smaller. As seen in the graph of FIG. 3, the difference in ink temperature from an area having four ink layers and the temperature of non-printed areas of the paper, also referred to herein as ink temperature delta, can be less than 15° C. at a web speed of 35 ips. As the web speed increases, the ink temperature delta increases because the web has less time to cool while traveling at higher rates of speed. As seen in FIG. 3, the difference in ink temperature, or temperature delta, between areas on the web having four ink layers and the temperature of non-printed areas of the web increases to greater than approximately 25° C. at a web speed of 70 ips.

In previous embodiments, in order to adjust the ink temperature on the web to the target temperature, one or more radiant heaters, also referred to herein as midheaters, were placed along the web path between the printing zone and the spreader to elevate the ink temperature to the target temperature prior to being spread. Radiant midheating may be capable of equalizing the ink and substrate temperatures to a certain degree. As mentioned, ink temperature increases with increasing ink mass so it takes more energy to raise the temperature of the ink in areas on the web that have multiple layers of ink than it does to raise the temperature of the ink in areas on the web that have single layers of ink and halftones. Also, the heat capacity of the web is generally lower than ink so it takes less energy to raise the temperature unprinted areas of the web than it does to raise the temperature of printed areas on the web. Therefore, as radiant heating is applied to the web, the temperature of the ink in areas on the web that have multiple layers rises more slowly than the temperature of the ink in areas on the web that have single layers of ink and halftones. Similarly, during radiant heating, the temperature of unprinted areas of the web rises faster than the temperature of the inked or printed areas of the web. At lower heating temperatures, however, midheaters deliver approximately the same amount of energy to all areas of the web, i.e., the different ink temperatures are raised substantially equally. At higher heating temperatures, radiant heating of the printed web has the effect of elevating the temperatures of the ink and web while decreasing the difference in temperature, or temperature delta, between high temperature areas, e.g., multiple ink layers, and low temperature areas, e.g., blank web, and single ink layers. Therefore, the degree to which the temperature deltas are equalized corresponds substantially to the amount of radiant heating applied to the web.

If the difference in ink temperatures is large prior to the midheating of the web, such as the case shown in FIG. 3 when the web speed is increased to 70 ips, midheating the web at lower radiant heating temperatures may have the effect of elevating temperature without substantially reducing the temperature spread, or temperature deltas. Conversely, heating the web at higher radiant heating temperatures may be effective in elevating the ink temperature as well as equalizing the temperature deltas. However, the temperature needed to equalize ink temperatures with a wide spread may cause the ink having already high temperatures to be raised to a degree that causes print quality defects such as ink show-through, ink splitting, and/or offset to the spreader roller.

Therefore, minimizing or equalizing the difference in ink temperatures of different ink formations, e.g., lines, halftones, single color solid fill areas, and multiple color solid fill areas, of an image on a web is advantageous. Accordingly, as an alternative to the use of midheating alone to elevate the temperature of the ink and web prior to entering the spreader, a system has been developed that is capable of equalizing ink and web temperatures and then elevating the equalized temperatures to a suitable temperature for the spreader 40. In particular, the system is configured to first equalize, or level, the ink and web temperatures using a leveler roller 50 followed by a radiant heater(s) 30 to apply heat to the web to elevate the leveled ink and web temperatures to the desired spreading temperatures.

Figure 2:
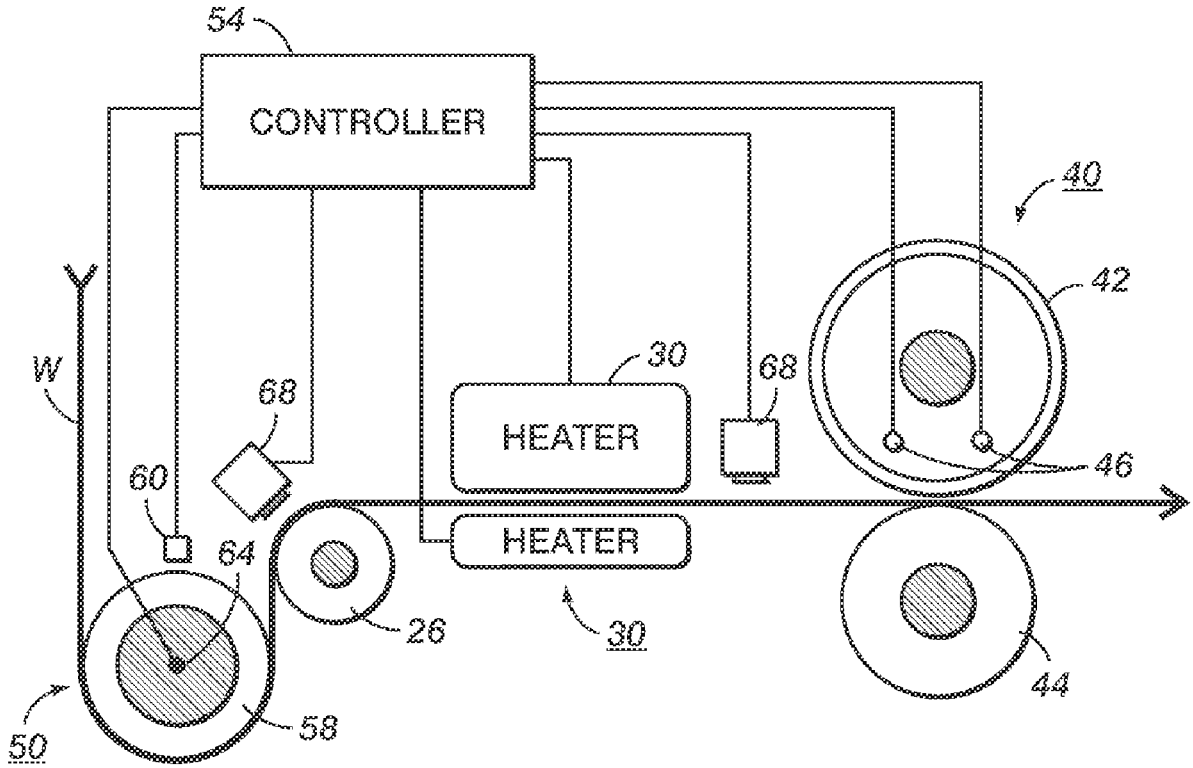
FIG. 2 is an enlarged elevation view of the leveler roller and midheater of the printer of FIG. 1.

A schematic diagram of an exemplary system for equalizing then elevating ink and web temperatures prior to spreading is depicted in FIG. 2. The system includes a leveler roller 50, one or more radiant heaters, a controller 54, and one or more temperature sensors 60 for sensing or detecting the temperatures of the leveler roller. As shown in FIG. 1, the leveler roller 50 may be placed along the web path between the printing zone and the spreader 40. In one embodiment, the leveler roller 50 is configured as an idler roller that derives its rotational motion from frictional engagement of the roller surface with the moving web. However, the leveler roller may be a driven in accordance with the web speed by a drive mechanism (not shown), such as a drive motor operably coupled to the roller. Suitable coupling may be through a drive belt, pulley, output shaft, gear or other conventional linkage or coupling mechanism. Tension rollers 26 may also be provided to control the carrying in angle and/or carrying out angle of the web relative to the leveler roller 50.

The leveler roller 50 is a temperature controlled, thermally conductive roller designed to operate at a temperature lower than the incoming ink and web temperatures. In one embodiment, the leveler roller is configured to operate at a target temperature of about 30° C. to about 45° C. Any suitable leveler roller operating temperature, however, may be used. The leveler roller includes a core 58 formed of a thermally conductive material, such as anodized aluminum, although the core may be made of other suitable materials, such as iron, nickel, stainless steel, and various synthetic resins.

The development of thermal energy in the leveler roller 50 may be accomplished in any suitable manner. For example, the core 58 may be hollow and include one or more heating elements 64 disposed therein for generating the required thermal energy in the roller. The heater 64 in the core may comprise a heating lamp such as quartz, carbon filament or halogen lamps. The roll temperature can also be heated or cooled with a fluid flowing through the roller and temperature controlled by an external device (current practice on our fixture). The heater 64 of the leveler roller 50 is configured to emit thermal radiation to heat the roller in accordance with an electrical current provided by one or more heater power supplies (not shown). Although internal heating means have been described for heating the leveler roller, the leveler roller may be heated by external heaters or a combination of internal and external heaters.

The heater 64 is controllable to heat the leveler roll 50 to different operating or target temperatures, e.g., 30° C. to about 45° C. One or more temperature sensors 60 may be provided for sensing the temperature of the leveler roller 50 and providing appropriate input to the controller 54. Temperature sensors 60 may be any type of temperature sensing device that generates an analog or digital signal indicative of a temperature in the vicinity of the sensor. Such sensors include, for example, thermistors that predictably change in some electrical property, such as resistance, in response to the absorption of heat. The controller 54 is connected to the temperature sensor 60 and to the power sources (not shown) of the heater 64 of the leveler roller. The controller 54 receives signals from the temperature sensor 60 indicative of the temperature of the leveler roller 50 and compares the sensed temperature of the roller to threshold values. Based on the comparison, the controller may adjust the power to the leveler roller heater to maintain the leveler temperature at the desired operating temperature. The controller may be implemented as hardware, software, firmware or any combination thereof. In addition, the controller may be a standalone controller or may be incorporated into the system controller. In addition, temperature sensors 68 may be positioned at various positions in the areas of the leveler, midheater and spreader to detect ink and web temperatures to ensure that the desired ink and web temperatures are reached at various points on the web path. Temperature sensors 68 may be any suitable type of temperature sensing device capable of detecting ink and/or web temperatures. The controller 54 is configured to receive temperature signals from the sensors 68 and may adjust power to the heating elements of the leveler, midheater, and spreader in any suitable manner to achieve desired ink and web temperatures.

During operation, as the web is moved along the web path, the web W is wrapped partially around the leveler roller as seen in FIG. 1. The length of the web that contacts the leveler roller is referred to herein as the wrap length, or contact length. Contact between the higher ink and web temperature with the lower temperature of the leveler roller causes conductive heat transference to occur between the web and the leveler roller thereby lowering the temperature of the ink and web toward the operating temperature of the leveler roller. The extent to which the ink and web temperatures may be equalized, or leveled, is generally a function of the temperature of the leveler roller, and the length of time, or dwell time, that the web W remains in contact with the leveler roller. As used herein, dwell time refers to the maximum amount of time that any given point on the web remains in contact with the leveler roller. Dwell time between the web and the leveler roller is dependent upon the speed that the web is moving and the wrap length, or contact length, between the web and the leveler roller. The wrap length at which the web is in contact with the web may be any suitable wrap length that is capable of creating adequate dwell time to level the ink and web temperatures in light of the web speed and operating temperature of the leveler roller.

Test runs were conducted in which the web was wrapped around the leveler roller for a wrap length of approximately 3.5 inches. With a 3.5 inch wrap length and a web speed of 70 ips, the dwell time between the web and the leveler roller is approximately 50 ms. A web speed of 35 ips and the 3.5 inch wrap length results in approximately 100 ms of dwell time. Ink was applied to the web in given areas with half (0.5) layers of ink (halftone), one ink layer, two ink layers, three ink layers, and four ink layers. A temperature sensor was used to detect the temperature of the ink and web upon entering the spreader. Separate tests were conducted without a leveler roller and with a leveler roller at an operating temperature of 30° C., 40° C., and 45° C. and with the web traveling at two different web speeds, 35 ips and 70 ips.

Figure 4:
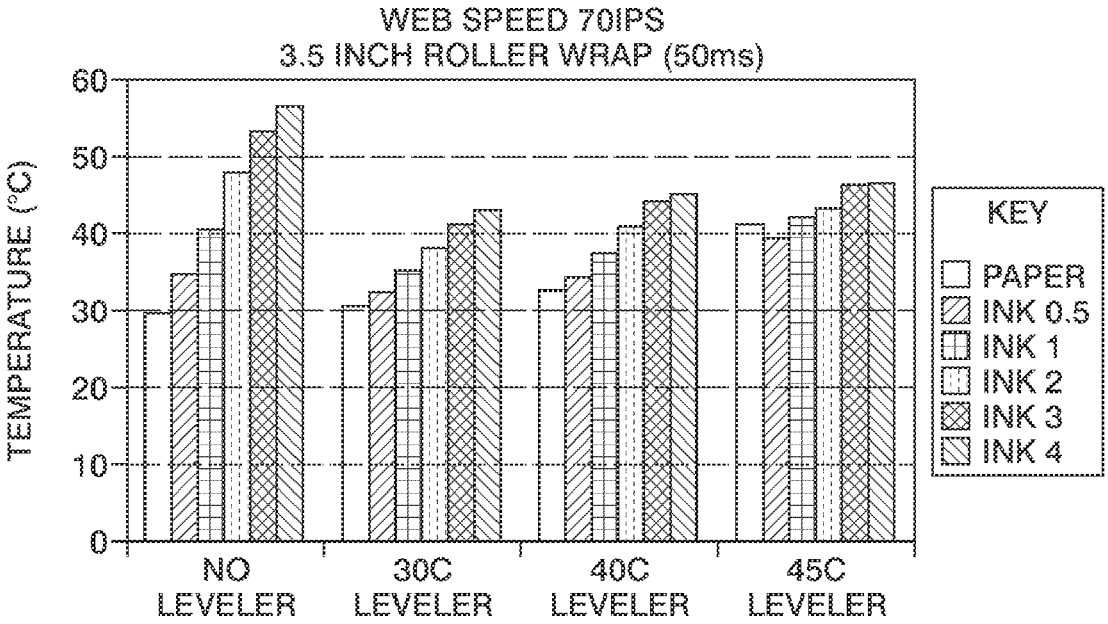
FIG. 4 is a bar graph showing ink and web temperatures with no leveler, and with the leveler at 30° C., 40° C., and 45° C. with the web moving at 70 ips.
Figure 5:
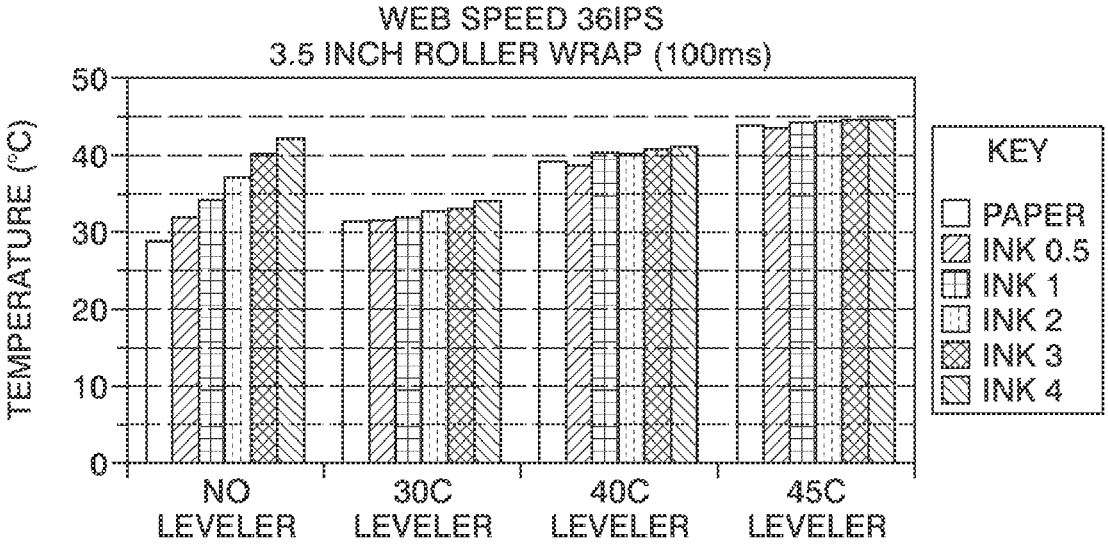
FIG. 5 is a bar graph showing ink and web temperatures with no leveler, and with the leveler at 30° C., 40° C., and 45° C. with the web moving at 35 ips.

FIGS. 4 and 5 depict bar graphs showing the resulting ink and web temperatures at 70 ips and 35 ips, respectively. Each graph depicts the ink and web temperatures with the leveler roller at 30° C., 40° C., and 45° C. as well as ink and web temperatures that result without the use of a leveler roller. The resulting ink and web temperatures at the far left of each graph depict the ink and web temperatures that result without using the leveler roller. As seen, the ink and web temperatures at both 35 ips (FIG. 5) and 70 ips (FIG. 4) without using the leveler roller correspond substantially to the ink and web temperatures shown in the graph of FIG. 3. The temperature spread for 35 ips is approximately 15° C. and the temperature spread at 70 ips is approximately 25° C. or greater. As depicted in FIG. 5, the approximately 100 ms of dwell time generated with the 3.5 inch wrap length at a web speed of 35 ips is capable of leveling the ink and web temperatures to within 5° C. of each other and lower at each of the leveler roller temperatures 30° C., 40° C., and 45° C. As depicted in FIG. 4, the approximately 50 ms of dwell time generated with the 3.5 inch wrap length at a web speed of 70 ips is capable of leveling the ink and web temperatures to within approximately 12° C. of each other at a leveler temperature of 30° C. At a leveler temperature of 45° C., the ink and web temperatures were equalized to within approximately 7° C. of each other.

As seen from the graphs of FIGS. 4 and 5, the leveler roller is capable of equalizing ink and web temperatures to a degree depending on the leveler operating temperature and the dwell time generated by a particular wrap length and web speed. A person of ordinary skill in the art, in light of the foregoing description, may make adjustments to wrap length, leveler temp, and even web speed to obtain substantially and suitable or desired equalization of the ink and web temps after printing and prior to any midheating or spreading.

As mentioned, the system includes one or more radiant heaters disposed along the web path downstream from the leveler roller and prior to the spreader. The midheaters 30 are configured to use radiant heat to bring the ink placed on the web to a temperature suitable for desired properties when the ink on the web is sent through the spreader 40. For example, heat may be generated in a midheater 30 by a resistance heating element. Alternatively, a heating panel may include one or more heating lamps such as quartz, carbon filament or halogen lamps mounted between a ceramic backing and a protective quartz plate (front side). In any case, the midheaters are configured to emit thermal radiation in accordance with an electrical current provided by one or more heater power supplies (not shown). As described below, the controller 54 is operable to control the amount of electrical current supplied to the heating panels via the power supplies. In one embodiment, a useful range for a target temperature for the paper web exiting the midheater 30 is about 30° C. to about 80° C. The midheater 30 is configured to use radiant heat to adjust the web and ink temperatures to 0° C. to 20° C. above the temperature of the spreader which may be, in one embodiment, approximately 55° C. as described above.

Following the spreader 40, the printer may include a "glosser" 50, whose function is to change the gloss of the image (such a glosser can be considered an "option" in a practical implementation). The glosser 50 applies a predetermined combination of temperature and pressure to obtain a desired amount of gloss on the ink that has just been spread by spreader 40. Additionally, the glosser roll surface may have a texture that the user desires to impress on the ink surface. The glosser 50 includes two rolls (image-side roll 52 and pressure roll 54) forming a nip through which the web W passes. In one practical embodiment, the controlled temperature at spreader 40 is about 35° C. to about 80° C. and the controlled temperature at glosser 50 is about 30° C. to about 70° C. Typical pressure against the web W for the roll pairs in each of the spreader 40 and the glosser may be about 500 to about 2000 psi. Adjustment of the pressure is advisable with ink formulations that are soft enough that high pressure would cause excessive spreading.

Following passage through the spreader 40 (and glosser if implemented) the printed web can be imaged on the other side, and then cut into pages, such as for binding (not shown). Although printing on a substantially continuous web is shown in the embodiment, the system described above can be applied to a cut-sheet system as well. Different preheat, midheat, and spreader temperature setpoints can be selected for different types and weights of web media.

Those skilled in the art will recognize that numerous modifications can be made to the specific implementations described above. Therefore, the following claims are not to be limited to the specific embodiments illustrated and described above. The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

What is claimed is:

1. A system for use with a direct to paper phase change ink imaging device, the system comprising:

a leveler roller positioned in the imaging device at a location that enables the leveler roller to receive a portion of a web onto which melted phase change ink has been applied before the portion of the web reaches the leveler roller, the leveler roller being formed of a thermally conductive material and including a heater configured to generate thermal energy to heat the leveler roller to a leveling temperature, the leveling temperature being less than a temperature of a continuous web moving along the web path and melted phase change ink on the moving continuous web, the leveler roller being positioned to be partially wrapped by the continuous web to generate a predetermined dwell time between the continuous web and the leveler roller as the continuous web is being moved, the predetermined dwell time being configured to allow conductive heat transfer to occur between the continuous web and the leveler roller to equalize the continuous web and the melted phase change ink temperatures on the web to within a predetermined range about the leveling temperature; and a midheater positioned in the imaging device at a location that enables the portion of a web to reach the midheater after the portion of the web has passed the leveler roller, the midheater configured to heat the continuous web and the melted phase change ink to a midheating temperature that is greater than the leveling temperature.

2. The system of claim 1, the location of the leveler roller enabling the leveler roller to be partially wrapped by the continuous web by a predetermined wrap length, the predetermined wrap length being a length along a surface of the leveler roller that the continuous web is in contact with the leveler roller, the predetermined wrap length corresponding to a speed of the continuous web along the web path to generate the predetermined dwell time.

3. The system of claim 2, the leveling temperature being between 30° C. and 45° C.

4. The system of claim 3, the leveler roller being formed of an anodized aluminum.

5. The system of claim 1, the midheating temperature being 0° C. to 20° C. above an operating temperature for the spreader.

6. The system of claim 4, the midheater comprising a radiant heater.

7. The system of claim 1, further comprising:

a temperature sensor configured to detect a temperature at a surface of the leveler roller and to generate a temperature signal indicative of the detected temperature; and a controller configured to receive the temperature signal and to control power to the heater of the leveler roller to keep the leveler roller at the leveling temperature.

8. A direct to paper phase change ink imaging device comprising:

a substantially continuous web;

a web supply and handling system configured to move the continuous web along a web path at a web speed;

a printing station disposed along the web path, the printing station including at least one printhead for applying melted phase-change ink to the continuous web;

a leveler roller positioned in the imaging device at a location that enables the leveler roller to receive the web after the printing station has applied the melted phase-change ink to the web, the leveler being formed of a thermally conductive material and including a heater configured to generate thermal energy to heat the leveler roller to a leveling temperature, the leveling temperature being less than a temperature of the continuous web and the melted phase change ink on the web, the leveler roller being partially wrapped by the continuous web to generate a predetermined dwell time between the continuous web and the leveler roller as the continuous web is being moved, the predetermined dwell time being configured to allow conductive heat transfer to occur between the continuous web and the leveler roller to bring a temperature of the continuous web and a temperature of melted phase-change ink on the continuous web to within a range about the leveling temperature;

a midheater positioned in the imaging device at a location that enables the midheater to heat a portion of the web after the portion of the web has past the leveler roller, the midheater configured to heat the continuous web to a midheating temperature, the midheating temperature being greater than the leveling temperature; and a spreader positioned in the imaging device at a location that enables the spreader to receive the portion of the web after the portion of the web has past the midheater, the spreader being configured to apply pressure to the melted phase-change ink on the continuous web.

9. The device of claim 8, the location of the leveler roller enabling the leveler roller to be partially wrapped by the continuous web by a predetermined wrap length, the predetermined wrap length being a length along a surface of the leveler roller that the continuous web is in contact with the leveler roller, the predetermined wrap length corresponding to a speed of the continuous web along the web path to generate the predetermined dwell time.

10. The device of claim 9, the leveling temperature being between 30° C. and 45° C.

11. The device of claim 10, the leveler roller being formed of an anodized aluminum.

12. The device of claim 11, the midheating temperature being 0° C. to 20° C. above an operating temperature for the spreader.

13. The device of claim 12, the midheater comprising a radiant heater.

14. The device of claim 8 further comprising:

a temperature sensor configured to detect a temperature at a surface of the leveler roller and to generate a temperature signal indicative of the detected temperature; and a controller configured to receive the temperature signal and to control power to the heater of the leveler roller to keep the leveler roller at the leveling temperature.

15. The device of claim 8, the printing station including at least a first printhead and a second printhead along the path, the first printhead having a first backing member associated therewith and the second printhead having a second backing member associated therewith, the first backing member and the second backing member being configured for independent control of the ink-receiving temperatures of the first backing member and the second backing member.

* * * * *